US009970421B2

(12) United States Patent
Coldren et al.

(10) Patent No.: US 9,970,421 B2
(45) Date of Patent: May 15, 2018

(54) DUAL-STAGE CRYOGENIC PUMP

(71) Applicant: Caterpillar Inc., Peoria, IL (US)

(72) Inventors: Dana R. Coldren, Secor, IL (US); Sana Mahmood, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 324 days.

(21) Appl. No.: 14/668,478

(22) Filed: Mar. 25, 2015

(65) Prior Publication Data

US 2016/0281690 A1 Sep. 29, 2016

(51) Int. Cl.

| | |
|---|---|
| ***F04B 19/22*** | (2006.01) |
| ***F04B 19/00*** | (2006.01) |
| ***F04B 1/12*** | (2006.01) |
| ***F04B 23/02*** | (2006.01) |
| ***F04B 9/117*** | (2006.01) |
| ***F04B 53/16*** | (2006.01) |
| ***F04B 15/08*** | (2006.01) |

(52) U.S. Cl.

CPC ..... *F04B 19/003* (2013.01); *F04B 1/12* (2013.01); *F04B 9/117* (2013.01); *F04B 15/08* (2013.01); *F04B 23/02* (2013.01); *F04B 53/16* (2013.01)

(58) Field of Classification Search

CPC ..... F04B 1/02; F04B 1/12; F04B 1/14; F04B 1/16; F04B 3/00; F04B 25/04; F04B 25/005; F04B 19/003; F04B 31/00; F04B 47/12; F04B 25/00; F04B 9/117; F04B 27/08; F04B 27/10; F04B 41/02; F04B 39/127; F04B 2015/081–2015/20; F04B 23/02; F04B 23/021; F04B 23/023; F04B 53/16; F04B 53/162; F04B 35/01; F04B 15/08; F04B 9/02; F04B 9/025

See application file for complete search history.

(56) References Cited

U.S. PATENT DOCUMENTS

| | | | | |
|---|---|---|---|---|
| 2,702,008 | A | 2/1955 | Stockhard | |
| 2,737,899 | A | 3/1956 | Bonnette et al. | |
| 3,834,836 | A | 9/1974 | Hein et al. | |
| 3,980,003 | A | 9/1976 | Huebner et al. | |
| 3,995,966 | A * | 12/1976 | Blancha | F04B 5/00 417/254 |
| 5,056,991 | A | 10/1991 | Peschka et al. | |
| 5,464,330 | A | 11/1995 | Prince et al. | |
| 5,884,488 | A | 3/1999 | Gram et al. | |
| 6,640,556 | B2 | 11/2003 | Ursan et al. | |
| 6,722,866 | B1 | 4/2004 | Dresler | |
| 8,840,377 | B2 | 9/2014 | Leece et al. | |

(Continued)

FOREIGN PATENT DOCUMENTS

| | | | |
|---|---|---|---|
| JP | 09158802 | | 6/1997 |
| JP | H09158802 | * | 6/1997 |
| JP | 2002089401 | | 3/2002 |

*Primary Examiner* — Bryan Lettman

(74) *Attorney, Agent, or Firm* — Finnegan, Henderson, Farabow, Garrett & Dunner, LLP; John Wappel

(57) ABSTRACT

A pump for use in pressurizing a cryogenic fluid. The pump may have a barrel, and a boost enclosure disposed around the barrel. The pump may also have a boost plunger disposed inside the barrel and configured to discharge fluid into the boost enclosure. The pump may further have a main plunger disposed inside the barrel and configured to receive fluid from the boost enclosure and to increase a pressure of the fluid.

18 Claims, 2 Drawing Sheets

(56) References Cited

U.S. PATENT DOCUMENTS

| | | | | |
|---|---|---|---|---|
| 2009/0047144 | A1* | 2/2009 | Leece | F04B 5/02 417/266 |
| 2012/0180764 | A1 | 7/2012 | Aritomi et al. | |
| 2014/0241913 | A1 | 8/2014 | Puckett | |
| 2014/0255219 | A1* | 9/2014 | Lucas | F04B 1/0452 417/282 |

* cited by examiner

DUAL-STAGE CRYOGENIC PUMP

TECHNICAL FIELD

The present disclosure relates generally to a pump and, more particularly, to dual-stage cryogenic pump.

BACKGROUND

Gaseous fuel powered engines are common in many applications. For example, the engine of a locomotive can be powered by natural gas (or another gaseous fuel) alone or by a mixture of natural gas and diesel fuel. Natural gas may be more abundant and, therefore, less expensive than diesel fuel. In addition, natural gas may burn cleaner in some application, and produce less greenhouse gas.

Natural gas, when used in a mobile application, may be stored in a liquid state onboard the associated machine. This may require the natural gas to be stored at cold temperatures, typically about −100 to −162° C. The liquefied natural gas is then drawn from the tank by gravity and/or by a boost pump, and directed to a high-pressure pump. The high-pressure pump further increases a pressure of the fuel and directs the fuel to the machine's engine. In some applications, the liquid fuel may be gasified prior to injection into the engine and/or mixed with diesel fuel (or another fuel) before combustion.

One problem associated with pumps operating at cryogenic temperatures involves flash boiling of the natural gas due to low pressures observed during retracting strokes of the pump's pistons. In order to avoid such low pressures, and thereby avoid flash boiling of the natural gas, typical cryogenic pump systems either incorporate large-diameter slow-moving pistons located at the bottom of a fuel tank to minimize pressure, or the systems include an additional boost pump that elevates a pressure of the fluid being directed to the pistons of a separate main pump. Using large diameter pistons results in large, heavy, and expensive pumps that create high-pressure spikes in downstream components (e.g., in accumulators that collect fluid from the pumps). The pressure spikes can be complex and expensive to accommodate (e.g., requiring additional components, such as regulators). Incorporating an additional boost pump can increase a cost of the pumping system and also reduce a reliability of the system.

An exemplary pump is disclosed in U.S. Pat. No. 5,464,330 (the '330 patent) that issued to Prince et al. on Nov. 7, 1995. In particular, the pump of the '330 patent includes a tank and three cylinder blocks disposed in the tank. Each cylinder block has a first stage cylinder and a second stage cylinder, with an associated piston disposed in each of the first and second stage cylinders. A crankshaft extends into the tank and includes an eccentric, lobe against which the first stage piston is biased. The second stage piston is free floating in the second stage cylinder.

During a suction stroke of the first stage piston of the '330 patent, hydraulic oil is sucked into the first stage cylinder past a first check valve. During a compression stroke, the first stage piston is driven to force the hydraulic oil out of the first stage cylinder past a second check valve into a passageway that is common to each of the cylinder blocks in the tank. During a suction stroke of the second stage piston, hydraulic oil from the passageway is drawn into the second stage cylinder past a third check valve. During a compression stroke of the second stage piston, the hydraulic, oil is driven to force the hydraulic oil out of the second stage cylinder past a fourth check valve into an outlet that is common to all of the cylinder blocks. A pressure of the fluid in the passageway is sufficient to move the second stage piston to its retracted position as the first stage piston is spring-biased to its retracted position.

While the pump of the '330 patent may be useful in some hydraulic oil applications, it may have limited applicability in cryogenic applications, in particular, the pressures experienced in cryogenic applications could be high enough to cause distortion of the cylinder blocks of the '330 patent. In addition, the passages and check valves of the '330 patent may not be sized properly for cryogenic applications, potentially causing flash boiling during the retracting strokes of the first and second stage pistons.

The disclosed pump is directed to overcoming one or more of the problems set forth above.

SUMMARY

In one aspect, the present disclosure is directed to a pump. The pump may include a barrel, and a boost enclosure disposed around the barrel. The pump may also include a boost plunger disposed inside the barrel and configured to discharge fluid into the boost enclosure. The pump may further have a main plunger disposed inside the barrel and configured to receive fluid from the boost enclosure and to increase a pressure of the fluid.

In another aspect, the present disclosure is directed to another pump. This pump may include a tank, a barrel disposed inside the tank, and a boost enclosure disposed inside the tank. The pump may also include a boost plunger disposed inside the barrel and configured to discharge fluid into the boost enclosure, and a plurality of inlet passages connecting a location inside the tank and separate from the boost enclosure to the barrel at the boost plunger. The pump may further include a main plunger disposed inside the barrel and configured to receive fluid from the boost enclosure and to increase a pressure of the fluid. A combined cross-sectional area of the plurality of inlet passages may be about equal to 0.4-0.7 times an exposed cross-sectional area of the boost plunger.

In yet another aspect, the present disclosure is directed to another pump. This pump may include a tank, a barrel disposed inside the tank, and a boost enclosure disposed inside the tank and around the barrel. The pump may also include a boost plunger disposed inside the barrel and configured to discharge fluid into the boost enclosure. The pump may further include a plurality of inlet passages connecting a location inside the tank and separate from the boost enclosure to the barrel at the boost plunger, and at least one check valve configured to selectively close the plurality of inlet passages. The pump may additionally include a free-floating main plunger disposed inside the barrel and configured to receive fluid from the boost enclosure and to increase a pressure of the fluid. The pump may also include a rotatable load plate, and a pushrod connected to the boost plunger and configured to transmit an undulating motion of the rotatable load plate axially to the boost plunger. A combined cross-sectional area of the plurality of inlet passages may be about equal to 0.4-0.7 times an exposed cross-sectional area of the boost plunger. Leakage from the free-floating main plunger may be directed to the boost plunger, and leakage from the boost plunger may be directed into the tank.

DETAILED DESCRIPTION

Figure 1:
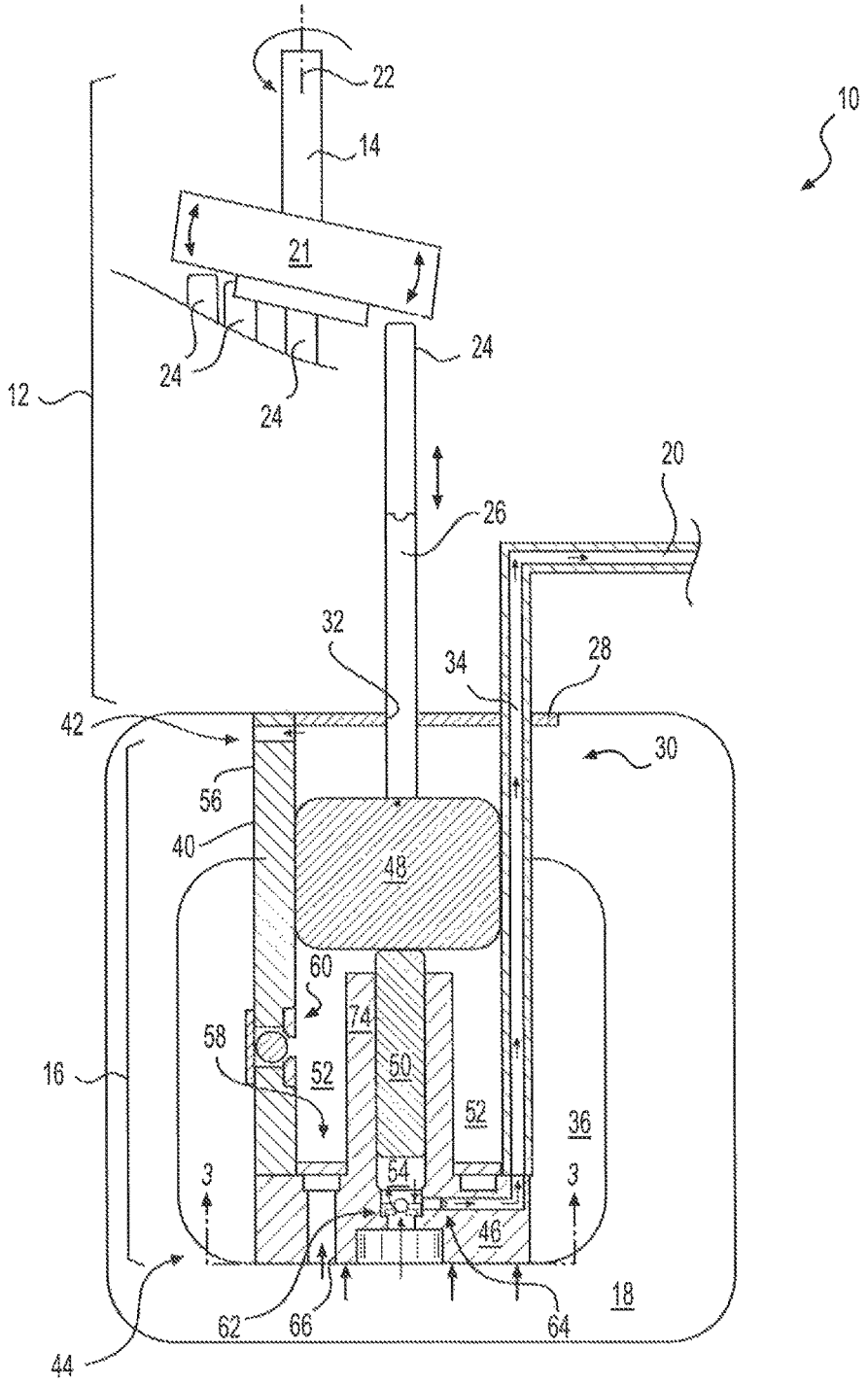
FIG. 1 is a cross-sectional and diagrammatic illustration of an exemplary disclosed pump.

FIG. 1 illustrates an exemplary pump 10. In one embodiment, pump 10 is mechanically driven by an external source of power (e.g., a combustion engine or electric motor—not shown), to generate a high-pressure fluid discharge. In the disclosed embodiment, the fluid passing through pump 10 is liquefied natural gas (LNG). It is contemplated, however, that pump 10 may alternatively or additionally be configured to pressurize and discharge a different cryogenic fluid, if desired. For example, the cryogenic fluid could be liquefied helium, hydrogen, nitrogen, oxygen, or another fluid known in the art.

Pump 10 may be generally cylindrical and divided into two ends. For example, pump 10 may be divided into a warm or input end 12, in which a driveshaft 14 is rotatably supported, and a cold or output end 16 that is at least partially submerged inside a fuel tank 18. With this configuration, a mechanical input may be provided to pump 10 at warm end 12 (i.e., via shaft 14), and used to draw liquid fuel from tank 18 at the opposing cold end 16. The liquid fuel may be pressurized by cold end 16, and discharged from pump 10 via a discharge passage 20. In most applications, pump 10 will be mounted and used in the orientation shown in FIG. 1 (i.e., with cold end 16 being located gravitationally lowest inside of fuel tank 18 to reduce pressure drop at cold en 16). It should be noted that, in some embodiments, a portion or all of warm end 12 could also be located inside fuel tank 18, if desired. Likewise, a portion of cold end 16 could protrude from fuel tank 18.

Warm end 12 may be relatively warmer than cold end 16. Specifically, warm end 12 may house multiple moving components that generate heat through friction during operation. In addition, warm end 12, being connected to the power source, may result in heat being conducted from the power source into pump 10. Further, if pump 10 and the power source are located in close proximity to each other, air currents may heat warm end 12 via convection. Finally, fluids (e.g., oil) used to lubricate pump 10 may be warm and thereby transfer heat to warm end 12, in contrast, cold end 16 may continuously receive a supply of fluid having an extremely low temperature. For example, LNG may be supplied to pump 10 from an associated storage tank at a temperature less than about −120° C.

Pump 10 may be a dual-stage axial piston type of pump. In particular, shaft 14 may be rotatably connected at an internal end to a load plate 21. Load plate 21 may oriented at an oblique angle relative to a central axis 22 of pump 10, such that an input rotation of shaft 14 may be converted into a corresponding undulating axial motion of load plate 21. A plurality of tappets 24 may slide along a lower face of load plate 21, and a pushrod 26 may be associated with each tappet 24. In this way, the undulating axial motion of load plate 21 may be transferred through tappets 24 to pushrods 26 and used to pressurize the fluid passing through pump 10. A resilient member (not shown), for example a coil spring, may be associated with each pushrod 26 and configured to bias the associated tappet 24 into engagement with load plate 21. Each pushrod 26 may be a single-piece component or, alternatively, comprised of multiple pieces, as desired. Many different shaft/load plate configurations may be possible, and the oblique angle of shaft 14 may be fixed or variable.

It should be noted that pump 10 could function differently, if desired. For example, load plate 21 could be replaced with a linear actuator, for example a single- or double-acting cylinder, if desired. The cylinder would be connected to or include pushrods 26, and be selectively supplied with or drained of fluid to generate the undulating axial motion described above. Other options may also be available.

A manifold 28 may be located at a transition region location between warm end 12 and cold end 16. Manifold 28 may function as a guide for pushrods 26, as a mounting pad for a plurality of pumping mechanism 30 (only one shown in FIG. 1), as a closure mechanism for tank 18, and as a distributer/collector of fluids for pumping mechanisms 30. Manifold 28 may include a plurality of bores 32 (only one shown) that are each configured to receive a corresponding pushrod 26. In addition, manifold 28 may have formed therein a common high-pressure outlet 34 in fluid communication with discharge passage 20. In some embodiment (not shown), manifold 28 may also have formed therein a low pressure inlet used to refill tank 18 and/or a return inlet for a consumer of the LNG fuel.

Cold end 16 may additionally include a boost enclosure 36 disposed around each one or all of pumping mechanisms 30 Boost enclosure 36 may be much smaller than tank 18 and disposed inside of tank 18. In the disclosed embodiment, tank 18 may have a volume of about 3,785 L (i.e., about 1,000 gallons), while boost enclosure 36 may have a volume of about 8 L (i.e., about 2 gallons). Boost enclosure 36 may be maintained separate from (i.e., fluidly sealed from) tank 18.

Any number of pumping mechanisms 30 may be connected to manifold 28 and hang down into boost enclosure 36. Each pumping mechanism 30 may include a generally hollow barrel 40 having a base end 42 connected to manifold 28, and an opposing distal end 44. A head 46 may be attached to distal end 44 to close off barrel 40. A lower end of each pushrod 26 may extend through manifold 28 into a corresponding barrel 40 to pivotally connect to a boost plunger 48. A high-pressure or main plunger 50 may be free floating within barrel 40, and located closer to distal end 44 than boost plunger 48. In this configuration, the reciprocating movement of pushrod 26 may translate into a sliding movement of boost and main plungers 48, 50 between Bottom-Dead-Center (BDC) and Top-Dead-Center (TDC) positions within barrel 40.

Barrel 40 may be divided into multiple different concentric pump chambers. In particular, barrel 40 may be divided into a larger boost chamber 52 and a smaller high-pressure chamber 54. Boost plunger 48 may reciprocate within boost chamber 52, while main plunger 50 may reciprocate within high-pressure chamber 54. In general, boost plunger 48 may have a larger diameter than main plunger 50, and an annular clearance around boost plunger 48 inside of boost chamber 52 may be larger than an annular clearance around main plunger 50 inside of high-pressure chamber 54. Leakage through the clearance around main plunger 50 may pass into boost chamber 52, while leakage through the clearance around boost plunger 48 may pass out into tank 18 (i.e., outside of boost enclosure 36) via a passage 56.

Head 46 may house valve elements that facilitate fluid pumping during the movement of boost and main plungers 48, 50 between their BDC and TDC positions. Specifically, head 46 may include a first inlet check valve 58, a boost check valve 60, a second inlet check valve 62, and a high-pressure check valve 64. First inlet check valve 58 may be configured to selectively allow low-pressure fuel (e.g., fuel having a pressure of about 0.1-0.5 MPa) from tank 18 to pass into boost chamber 52. Boost check valve 60 may be configured to selectively allow medium-pressure fuel (e.g., fuel having a pressure of about 2-8 MPa) from boost chamber 52 into boost enclosure 36. Second inlet check valve 62 may be configured to selectively allow the medium-pressure fuel from boost enclosure 36 into high-pressure chamber 54. High-pressure check valve 64 may be configured to selectively allow high-pressure fuel (e.g., fuel having a pressure of about 40-45 MPa) from high-pressure chamber 54 through high-pressure outlet 34 into discharge passage 20. Each of these check valves may take any form known in the art, for example a ball check valve, a reed check valve, a ring check valve, etc., as long as they each provide for a unidirectional flow of fuel at the respective desired pressure thresholds.

In a first embodiment illustrated in FIG. 1, first inlet check valve 58 is a ring check valve associated with a plurality of inlet passages 66 that communicate with boost chamber 52. In particular, inlet passages 66 may be circular axial passages that are generally parallel with axis 22 and extend through a floor of boost chamber 52 to communicate with tank 18. Inlet passages 66 may be evenly spaced around a periphery of high-pressure chamber 54, and have a combined cross-sectional flow area about equal to (i.e., within manufacturing tolerances) 0.4-0.7 times of an exposed cross-sectional area of boost plunger 48. This area relationship may help to limit the creation of a low-pressure region inside boost chamber 52 during retraction of boost plunger 48 that could cause flash boiling of the fuel entering boost chamber 52. In addition, openings of inlet passages 66 may be located as close to a bottom of tank 18, without causing a restriction in fluid flow into inlet passages 66. For example, head 46 may be located a distance away from tank 18 that maintains at least the same radial cross-sectional flow between head 46 and the bottom of tank 18 as there is passing axially through inlet passages 66.

Figure 2:
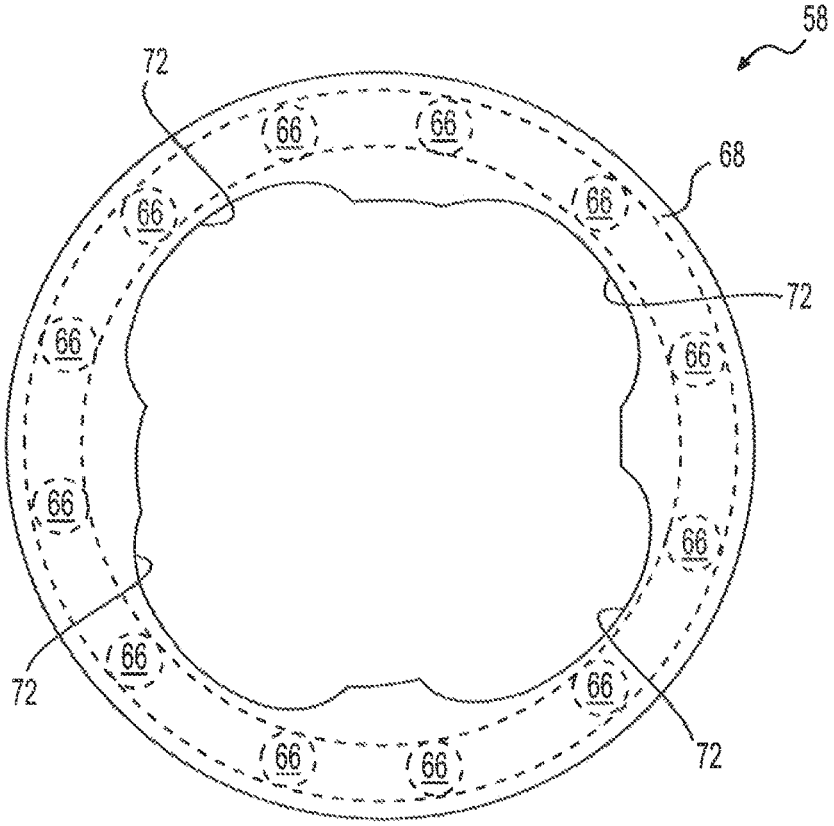
FIGS. 2 and 3 are enlarged end-view isometric illustrations of exemplary portions of the pump shown in FIG. 1.

As shown in the cross-sectional view of FIG. 1 and in the end view of FIG. 2, first inlet check valve 58 may have a ring-shaped body 68 received within boost chamber 52 that is configured to inhibit fluid flow through each of inlet passages 66 into boost chamber 52. In particular, body 68 may be configured to block a common groove 70 at an outlet of passages 66 and thereby inhibit flow into boost chamber 52 as boost plunger 48 moves downward. Likewise, body 68 may be configured to move away from and thereby allow flow through inlet passages 66 as boost plunger moves upward within boost chamber 52. It is contemplated that an inner and/or outer radial edge of body 68 could be shaped to receive one or more guides that promote smooth axial movement of first inlet check valve 58 inside boost chamber 52. For example, the inner radial edge of body 68 is shown in FIG. 2 as having one or more internal recesses 72 that receive corresponding lobes 74 (referring to FIG. 1) protruding outward from walls of high-pressure chamber 54.

Figure 3:
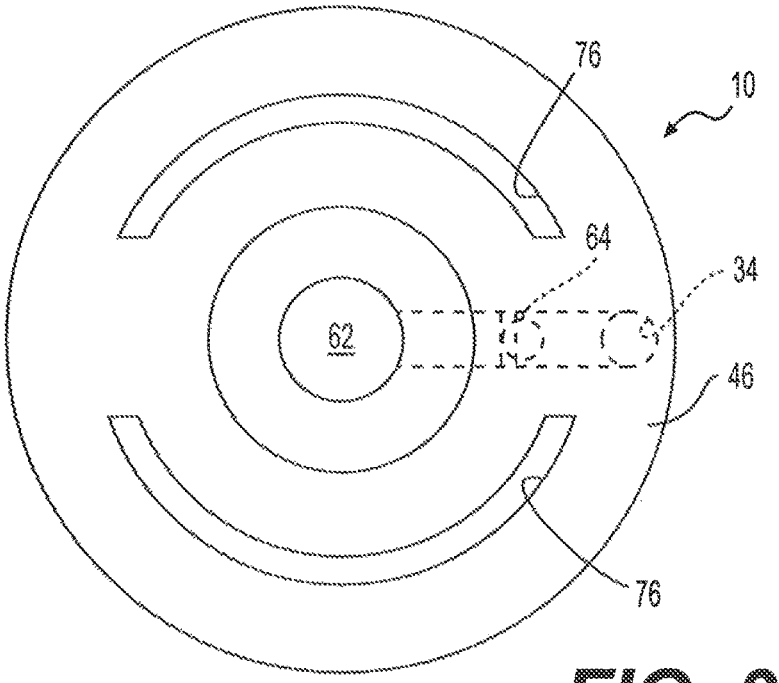

In an alternative embodiment shown in the pump end view of FIG. 3, inlet passages 66 may be replaced with differently shaped inlet passages. In particular, pump 10 may include one or more arcuate inlet passages 76 that extend up through the floor of boost chamber 52. In this embodiment, the valve elements of first inlet check valve 58 may be arcuately shaped wedges that fit into and block inlet passages 76. Other shapes of passages and/or valve elements may be used, as desired.

INDUSTRIAL APPLICABILITY

The disclosed pump finds potential application in any fluid system where high-pressurization of cryogenic fluids is required. The disclosed pump finds particular applicability in engine applications, for example engine applications that burn LNG fuel. One skilled in the art will recognize, however, that the disclosed pump could be utilized in relation to other fluid systems that may or may not be associated with an engine. The disclosed pump may be capable of producing high-pressures, with high efficiency and low occurrence of flash boiling. Operation of pump 10 will now be explained.

Referring to FIG. 1, when driveshaft 14 is rotated by an engine (or another power source), load plate 21 may be caused to undulate in the axial direction. This undulation may result in translational movement of tappets 24 and corresponding movements of pushrods 26, connected boost plungers 48, and free-floating main plungers 50 of each pumping mechanism 30. Within each pumping mechanism, the rotation of driveshaft 14 may cause both axial extension and retraction of boost plunger 48 relative to boost chamber 52 and, because of the abutment of boost plunger 48 with main plunger 50, also the extension of main plunger 50 into high-pressure chamber 54. As will be described in more detail below, the retraction of main plunger 50 from high-pressure chamber 54 may be caused by a pressure of fuel in high-pressure chamber 54 as boost plunger 48 is moved away from main plunger 50.

As boost plunger 48 cyclically rises and falls within barrel 40, this reciprocating motion may function to draw in low-pressure fuel from tank 18 and discharge medium-pressure fuel into boost enclosure 36. Specifically, the retractions of boost plunger 48 may cause low-pressure fuel from a location inside tank 18 and outside of boost enclosure 36 to flow through inlet passages 66 of head 46 and past first inlet check valve 58 into boost chamber 52. It should be noted that the large flow area of inlet passages 66 and first check valve 58 may reduce a magnitude of the low-pressure generated during boost plunger retraction, such that flash boiling is avoided. The ensuing extension of boost plunger 48 may push the fuel at the medium pressure from boost chamber 52 past boost check valve 60 and into boost enclosure 36.

The medium-pressure fuel in boost enclosure 36 may flow through second inlet check valve 62 into high-pressure chamber 54, causing main plunger 50 to retract from high-pressure chamber 54. When boost plungers 48 are forced downward by the undulating motion of load plate 21, boost plungers 48 may also force main plungers 50 downward into high-pressure chambers 54. The extension of main plungers 50 into high-pressure chambers 54 may push the liquid fuel therein out past high-pressure check valve 64 into high-pressure outlet 34 and discharge passage 20.

During operation of pump 10, some of the liquid fuel may leak past plungers 48 and 50, and some of the leaked fuel may vaporize. For example, fuel may leak from high-pressure chamber 54 around main plunger 50 and into boost chamber 52, and some of this fuel may be gaseous. Fuel that leaks into boost chamber 52 may cool somewhat inside boost chamber 52, and recondense during the compressing stroke of boost plunger 48 before being directed into boost enclosure 36. Similarly, fuel may leak from boost chamber 52 around boost plunger 48, and some of this fuel may be gaseous. Fuel that leaks around boost plunger 48 may cool at the back side of boost plunger 48 and recondense before, during, and/or after being directed into tank 18 via passage 56.

The disclosed pump may have many associated benefits. For example, the disclosed pump may be designed to produce pressures high enough for use within cryogenic applications. In addition, because boost enclosure 36 may be located around boost chamber 52 and because boost chamber 52 may be located around high-pressure chamber 54, distortion of these chambers may be constrained somewhat by the surrounding volumes of high-pressure fuel. Accordingly, less distortion may occur, allowing for longevity of pump 10. Further, the passages and cheek valves of pump 10 may be designed to reduce low pressures normally encountered during retracting plunger strokes. As a result, the occurrence of flash boiling during operation of pump 10 may be low.

It will be apparent to those skilled in the art that various modifications and variations can be made to the pump of the present disclosure. Other embodiments of the pump will be apparent to those skilled in the art from consideration of the specification and practice of the pump disclosed herein. It is intended that the specification and examples be considered as exemplary only, with a true scope being indicated by the following claims and their equivalents.

What is claimed is:

1. A pump, comprising:

a barrel;

a boost enclosure disposed around the barrel;

a boost plunger disposed inside the barrel and configured to discharge fluid into the boost enclosure; and a main plunger disposed inside the barrel and configured to receive fluid from the boost enclosure and to increase a pressure of the fluid, wherein the main plunger is free floating and configured to be moved to a retracted position by a pressure of the fluid in the boost enclosure.

2. The pump of claim 1, further including a tank, wherein:

the boost enclosure and the barrel are located inside the tank; and the boost plunger is configured to draw fluid into the barrel from a location inside the tank and separate from the boost enclosure.

3. The pump of claim 2, wherein leakage from the main plunger is directed to the boost plunger.

4. The pump of claim 3, wherein leakage from the boost plunger is directed into the tank.

5. The pump of claim 2, further including a plurality of inlet passages connecting the tank to the barrel at the boost plunger.

6. The pump of claim 5, further including at least one check valve configured to selectively close the plurality of inlet passages.

7. The pump of claim 6, wherein the at least one check valve has a ring-shaped body configured to simultaneously inhibit flow through the plurality of inlet passages.

8. The pump of claim 7, further including at least one internal recess formed in the ring-shaped body and configured to engage a guide formed in the barrel.

9. The pump of claim 7, wherein each of the plurality of inlet passages is circular.

10. The pump of claim 7, wherein each of the plurality of inlet passages is arcuate.

11. The pump of claim 5, wherein a combined cross-sectional area of the plurality of inlet passages is equal to 0.4-0.7 times an exposed cross-sectional area of the boost plunger.

12. The pump of claim 1, further including a mechanical input device connected to the boost plunger.

13. The pump of claim 12, wherein an extending movement of the boost plunger causes the main plunger to extend.

14. The pump of claim 12, wherein the mechanical input device includes:

a rotatable load plate; and a pushrod transmitting an undulating axial motion of the rotatable load plate to the boost plunger.

15. A pump, comprising:

a tank;

a barrel disposed inside the tank;

a boost enclosure disposed inside the tank;

a boost plunger disposed inside the barrel and configured to discharge fluid into the boost enclosure;

a mechanical input device connected to the boost plunger;

a plurality of inlet passages connecting a location inside the tank and separate from the boost enclosure to the barrel at the boost plunger; and a main plunger disposed inside the barrel and configured to receive fluid from the boost enclosure and to increase a pressure of the fluid, the main plunger being free floating and configured to be moved to a retracted position by a pressure of the fluid in the boost enclosure and configured so that an extending movement of the boost plunger causes the main plunger to extend, wherein a combined cross-sectional area of the plurality of inlet passages is equal to 0.4-0.7 times an exposed cross-sectional area of the boost plunger.

16. The pump of claim 15, wherein:

leakage from the main plunger is directed to the boost plunger; and leakage from the boost plunger is directed into the tank.

17. The pump of claim 15, further including at least one check valve configured to selectively close the plurality of inlet passages, the at least one check valve having a ring-shaped body configured to simultaneously inhibit fluid flow through the plurality of inlet passages.

18. A pump, comprising:

a tank;

a barrel disposed inside the tank;

a boost enclosure disposed inside the tank and around the barrel;

a boost plunger disposed inside the barrel and configured to discharge fluid into the boost enclosure;

a plurality of inlet passages connecting a location inside the tank and separate from the boost enclosure to the barrel at the boost plunger;

at least one check valve configured to selectively close the plurality of inlet passages;

a free-floating main plunger disposed inside the barrel and configured to receive fluid from the boost enclosure and to increase a pressure of the fluid;

a rotatable load plate; and a pushrod connected to the boost plunger and configured to transmit an undulating axial motion of the rotatable load plate to the boost plunger, wherein:

a combined cross-sectional area of the plurality of inlet passages is equal to 0.4-0.7 times an exposed cross-sectional area of the boost plunger;

leakage from the free-floating main plunger is directed to the boost plunger; and leakage from the boost plunger is directed into the tank.

* * * * *